US005701643A

United States Patent [19]

Fleissner

[11] Patent Number: 5,701,643

[45] Date of Patent: Dec. 30, 1997

[54] METHOD FOR COMPACTION OF FIBER FLEECE

[75] Inventor: Gerold Fleissner, Zug, Switzerland

[73] Assignee: Fleissner GmbH & Co. Maschinenfabrik, Egelsbach, Germany

[21] Appl. No.: 671,343

[22] Filed: Jun. 27, 1996

[30] Foreign Application Priority Data

Jun. 27, 1995 [DE] Germany ..... 195 22 763.8

[51] Int. Cl.[6] ..... D04H 1/46

[52] U.S. Cl. ..... 28/105

[58] Field of Search ..... 28/104, 105, 103; 19/296, 299, 304

[56] References Cited

U.S. PATENT DOCUMENTS

| | | | |
|---|---|---|---|
| 4,775,579 | 10/1988 | Hagy et al. | 28/104 |
| 4,840,838 | 6/1989 | Wyss | 28/104 |
| 5,328,759 | 7/1994 | McCormack et al. | 28/104 |
| 5,396,689 | 3/1995 | Vuillaume | 28/104 |

*Primary Examiner*—Michael A. Neas

*Attorney, Agent, or Firm*—Antonelli, Terry, Stout & Kraus, LLP.

[57] ABSTRACT

Fiber fleeces made of synthetic fibers or of natural fibers are compacted after their formation, for example, by carding or by simply being laid down in endless fiber fleeces. In the fleece according to the invention, which is intended to be voluminous yet compact, neither low-melting binding fibers nor chemical binders are used for the purpose. The mechanical needling method, i.e. with needles, cannot be used, however, because the volume is reduced too sharply. The desired volume is retained and the double fleece desired for hygienic products, for example, is achieved by the fleece produced, for example, on a card machine or aerodynamically initially being laid down on a previously compacted fleece, such as spun fleece made of endless fibers for example, as the carrier fleece and then being compacted in a continuous processing method by water needling at a water pressure of at least 100 bars and, preferably 180 bars, and thus being simultaneously joined to the carrier fleece.

6 Claims, 1 Drawing Sheet

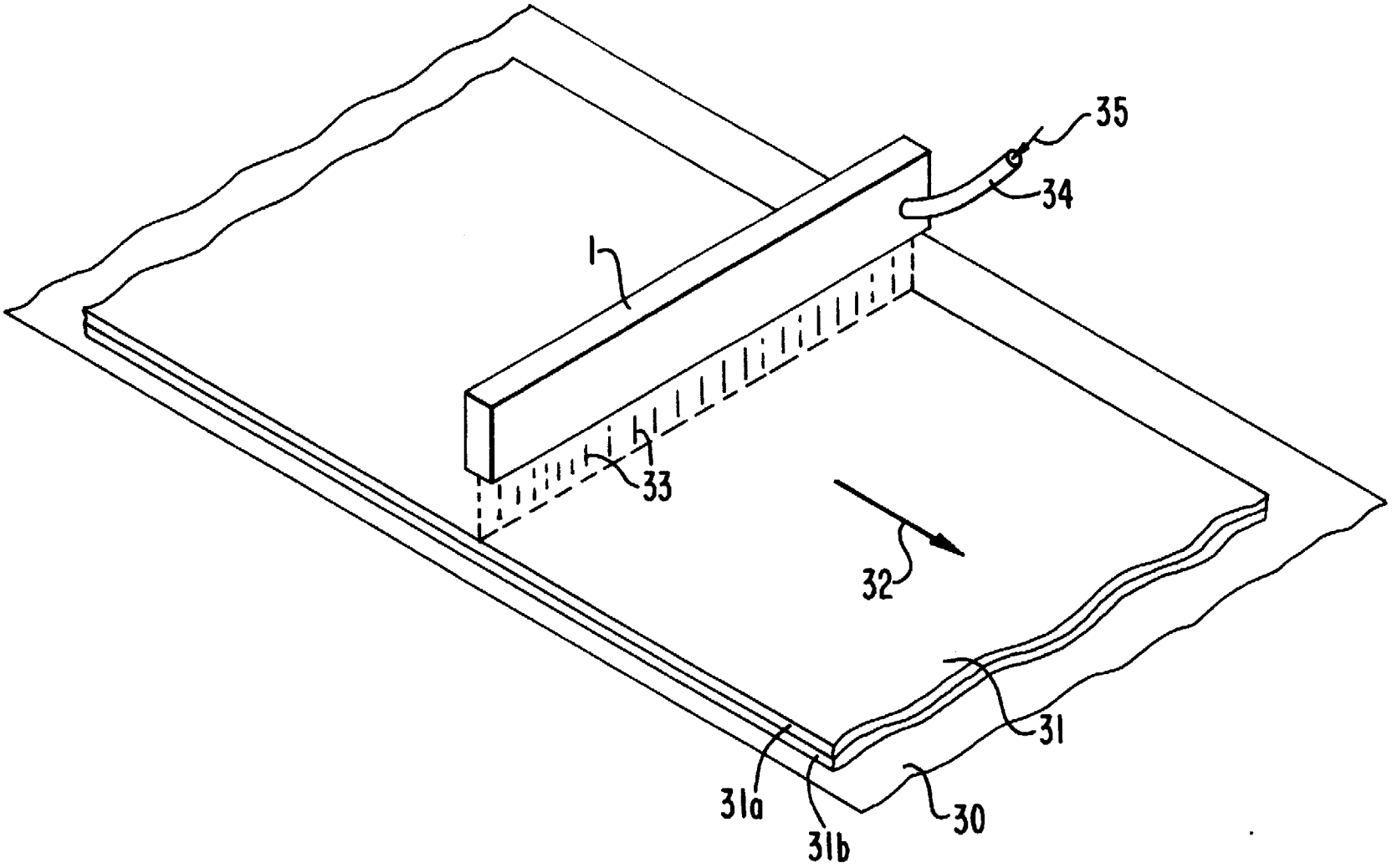
35
34
1
33
32
31
30
31b
31a

METHOD FOR COMPACTION OF FIBER FLEECE

FIELD OF INVENTION

This invention relates to a method for compaction of a fiber fleece made of manmade (i.e. synthetic) staple fibers, such as polyester, polyethylene, or polypropylene fibers, and/or natural fibers (e.g., cotton, wool, etc.), said fleece being produced in a thickness of up to 10 mm or more from the synthetic fibers alone without binding fibers such as bi-component or special melting fibers and without binders, or mixed with natural fibers.

BACKGROUND OF THE INVENTION

Card fiber fleeces are made from fibers of very many different kinds. They share the general advantage that the short fibers are arranged at random in the finished fleece and therefore lend the fleece improved strength in all pulling directions. There are also fleeces made of endless fibers that are immediately laid down on a spun fleece after the fibers are produced, on an endless belt for example. The fibers distributed loosely in the fleece supplied from the card as well as those of a spun fleece must be joined together, however, to produce a strength that is satisfactory in practice. It is known to needle the fleece mechanically for this purpose. However, the volume is significantly reduced by this basically discontinuous and hence slow compaction process, so that such mechanically compacted needled fleece cannot be used for as many possible applications. In addition, these fleece cannot be needled mechanically at all.

It is known to add binders to the fibers, in liquid form by spraying or by foam impregnation for example. The disadvantage of such a fleece is not only the additional expensive binder chemicals required, which cannot be produced without a certain amount of environmental impact, but also the poorer recyclability of such fleeces.

It is also known to mix fibers made of lower-melting-point chemical fibers, including bi-component fibers, with fleeces, said fibers then being at least initially melted under the influence of heat so that they stick to the adjacent fibers of the fleece. The costly fibers and the additional energy cost required for heating the binding fibers to the melting point are disadvantageous in this regard.

It is also known to use water to needle fleeces of the type mentioned above. Water needling has the basic advantage that it proceeds continuously, making higher production rates possible.

For hygienic products it is known in the case of diapers for example to place several types of fleece on top of one another. Thus, it is conventional to lay a cellulose layer as a wicking or liquid equalization element beneath a spun fleece that comes in contact with the skin. This is followed by a separating tissue and finally a super-absorbent SAP is provided for the bodily fluid to be captured, said SAP being shielded from the outside by a final liquid impermeable layer. In order to be able to make the diaper or the like thinner and possibly cheaper, it is known to replace the cellulose layer by a staple fiber fleece made of totally synthetic fibers, i.e. with binder fiber or binder liquids, since such fibers also have good wicking properties.

Only the compaction of these synthetic fiber fleeces is expensive, especially the joining of the compacted spun fleece with the compacted staple fiber fleece. Admixed low-melting-point chemical fibers, hi-component fibers, or additional binders can be used to effect compaction and joining of the two fleeces. The obvious disadvantages of these joining methods have been explained above, however.

SUMMARY OF THE INVENTION

The goal of the invention is to develop a method for making a compacted yet voluminous fleece such as card fiber fleece, in which no additional binding chemicals or binding fibers are required for compaction but the required strength of the fleece as well as the joining to the carrier fleece can nevertheless be achieved.

Taking its departure from the methods heretofore described, this goal is achieved by virtue of the fact that the fleece of synthetic and/or natural fibers produced on a card machine or aerodynamically, for example, is laid down on a previously compacted fleece such as spun fleece composed of endless synthetic fibers, for example, and serving as the carrier fleece, and is joined to the carrier fleece in a continuous treatment process by water needling at a water pressure of at least 100 bars and preferably 180 bars and is simultaneously compacted thereby.

BRIEF DESCRIPTION OF THE DRAWINGS

A device for carrying out the method of the invention is shown in the accompanying drawing wherein the sole FIGURE is a perspective view of the fiber web running lengthwise with only one nozzle being mounted above it for hydro loop compaction by water needling.

DETAILED DESCRIPTION OF THE INVENTION

The sole FIGURE shows schematically an endless belt 30 which advances together with a composite fleece consisting of a fleece layer of staple fibers 31*a* laid onto a carrier fleece layer of spun fibers 31*b* to be compacted in the direction of arrow 32. A nozzle beam with an upper part 1 is located transversely with respect to the belt, at a distance above the composite fleece 31. The streams of water 33 emerging from a nozzle slot of the nozzle beam are directed against the fleece 31 and sweep the width of the fleece to effect water needling of the layers 31*a* and 31*b*. The water 35 required for this needling operation enters the nozzle beam through a hose 34 at one end of the nozzle beam.

Further details of the device shown in the sole FIGURE of drawings are described with reference to FIG. 4 in copending patent application Ser. No. 08/590,324, filed on Jan. 23, 1996, the disclosure of which is incorporated herein by reference. It will be understood that in the device for working the method of the present invention only a single pressure stage or beam is necessary, the beam being equipped with a nozzle sheet with the necessary througholes for the water, that is only 20 holes per inch.

Surprisingly, it has been found that the staple fiber fleece, as it comes from the card machine or from an aerodynamic process loses volume when water-needled at the water pressure of at least 100 bars, but only to a degree that is insignificantly small as far as this application is concerned. In any event, the fibers are felted by the impact of the water streams with the water pressure such that a sufficiently compacted fleece is delivered by the water-needling machine, and this staple fiber fleece is mechanically combined with the carrier fleece at the same time; in other words, it is needled by the water streams together with the carrier fleece. This compaction method is especially economical because two product-manufacturing steps that are usually performed separately have been combined into a single step.

During compaction of the staple fiber fleece, the process of joining it to the spun fleece, which naturally can be another fleece product, takes place at the same time.

The process can also be viewed in reverse, namely during the joining of the staple fiber fleece to the carrier fleece, the necessary compaction of the staple fiber fleece takes place at the same time without designated volume of the latter fleece being lost.

To join the fleeces during the water-needling, only one pressure stage is sufficient, with a nozzle beam that has twenty holes per inch, for example, as shown in the accompanying FIGURE.

What is claimed is:

1. A method, comprising: providing a fiber fleece comprising staple fibers having a thickness of at least 10 mm without binding fibers and without binders, the fiber fleece being made on a card machine or aerodynamically;

laying the fiber fleece on a previously compacted fleece comprising spun fleece made of endless fibers as a carrier fleece; and joining the fiber fleece to the carrier fleece and simultaneously compacting the fiber fleece in a continuous processing operation by means of a water-needling device at a water pressure of at least 100 bars.

2. A method according to claim 1, wherein the water streams of the water-needling device act through the fiber fleece in the direction of the carrier fleece.

3. A method according to claim 1, wherein the continuous processing operation is carried out at a water pressure of at least 180 bars.

4. A method according to claim 1, wherein said staple fibers comprise synthetic fibers.

5. A method according to claim 4, wherein said synthetic fibers are made of a material selected from the group consisting of polyester, polyethylene and polypropylene.

6. A method according to claim 4, wherein said staple fibers further comprise natural fibers.

* * * * *